US009627808B2

(12) United States Patent
Bonucci et al.

(10) Patent No.: US 9,627,808 B2
(45) Date of Patent: Apr. 18, 2017

(54) ONE PIECE CONNECTOR WITH INTEGRAL LATCHING MEMBERS

(71) Applicant: TYCO ELECTRONICS BRASIL LTDA., Sao Paulo (BR)

(72) Inventors: Gustavo Bonucci, Braganca Paulista (BR); Leandro Westmann Prado, Braganca Paulista-SP (BR); Cassiano G. Martins, Braganca Paulista (BR)

(73) Assignee: TYCO ELECTRONICS BRASIL LTDA (BR)

( * ) Notice: Subject to any disclaimer, the term of this patent is extended or adjusted under 35 U.S.C. 154(b) by 75 days.

(21) Appl. No.: 14/684,913

(22) Filed: Apr. 13, 2015

(65) Prior Publication Data

US 2016/0301159 A1 Oct. 13, 2016

(51) Int. Cl.
*H01R 13/627* (2006.01)
*H01R 13/52* (2006.01)

(52) U.S. Cl.
CPC ..... *H01R 13/6273* (2013.01); *H01R 13/5202* (2013.01)

(58) Field of Classification Search
CPC ..... H01R 13/6273; H01R 13/5202
See application file for complete search history.

(56) References Cited

U.S. PATENT DOCUMENTS

| | | | | | |
|---|---|---|---|---|---|
| 3,523,269 | A * | 8/1970 | Bissland | H01R 13/743 | 439/358 |
| 3,790,923 | A * | 2/1974 | Mathe | H01R 13/743 | 248/27.3 |
| 4,789,343 | A * | 12/1988 | Dougherty | B60G 17/015 | 439/34 |
| 4,963,102 | A * | 10/1990 | Gettig | H01R 13/28 | 439/291 |
| 5,015,200 | A * | 5/1991 | Abernethy | H01R 13/6271 | 439/357 |
| 5,035,639 | A * | 7/1991 | Kilpatrick | H01R 13/28 | 439/290 |
| 5,542,859 | A * | 8/1996 | Ison | H01R 13/74 | 248/27.1 |
| 5,651,697 | A * | 7/1997 | Cinquegrani | H01R 13/6272 | 439/374 |
| 2008/0299811 | A1* | 12/2008 | Battista | H01R 13/6273 | 439/345 |
| 2013/0115797 | A1* | 5/2013 | Keswani | H01R 4/4818 | 439/345 |
| 2014/0199874 | A1* | 7/2014 | Tseng | H01R 13/64 | 439/345 |

* cited by examiner

*Primary Examiner* — Briggitte R Hammond

(57) ABSTRACT

An electrical connector having a housing, a seal and a retainer. The housing includes a component receiving opening which extends through a mating end. The housing is molded from a first material. The seal is provided in the component receiving opening and is integrally molded in the component receiving opening of the housing, the seal being molded from a second material which is different than the first material. The retainer is positioned proximate the mating end and is integrally molded to the housing. The retainer cooperates with a mating component to retain the mating component in the component receiving opening.

19 Claims, 8 Drawing Sheets

ONE PIECE CONNECTOR WITH INTEGRAL LATCHING MEMBERS

FIELD OF THE INVENTION

The present invention is directed to a connector for mating to a mating connector or component. In particular, the invention is directed to a unitarily molded connector with integral latching members.

BACKGROUND OF THE INVENTION

Electrical components that are mounted in the engine compartment of a vehicle are subjected to wide ranges of environmental conditions and physical abuse. In particular, electrical components in an engine compartment are subject to substantial ranges in temperature due to climatic changes and engine operating conditions. These components are exposed to soil and are frequently splashed with water, lubricants and fuels. Electrical components on a vehicle are almost continuously subjected to vibrations during use, are frequently subjected to sharp jarring movement as the vehicle traverses a rough road, and are often directly contacted by maintenance personnel working in the engine compartment.

Developers of automotive electrical components must address the various demands that are imposed upon the connector. Additionally, specifications generally limit these electrical components to a small space envelope in view of the increased crowding of electrical and mechanical components in the engine compartment of a vehicle. The electronics industry also is extremely competitive, and it is necessary for the engineer to design components at a minimum relative cost. Even small savings in size or cost can be very significant.

In such environments, it is important that the connectors be maintained in electrical engagement. This is often accomplished through the use of spring clips which are inserted into recesses of the housing of the connector. The spring clips cooperate with mating connectors or components to maintain the connector and mating connector in both mechanical and electrical engagement. While these spring clips are effective, they are additional components which can be inadvertently removed, potentially causing damage to the engine or other components.

It would, therefore, be beneficial to provide a connector housing with integral latching members which minimizes the number of separate and discrete components. It would also be beneficial to provide such a connector housing with integral latching members which eliminates the need for product assembly, decreases the production cycle time and reduces the inventory of components.

SUMMARY OF THE INVENTION

An embodiment is directed to an electrical connector having a housing, a seal and a retainer. The housing includes a component receiving opening which extends through a mating end. The housing is molded from a first material. The seal is provided in the component receiving opening and is integrally molded in the component receiving opening of the housing, the seal being molded from a second material which is different than the first material. The retainer is positioned proximate the mating end and is integrally molded to the housing. The retainer cooperates with a mating component to retain the mating component in the component receiving opening.

An embodiment is directed to an electrical connector having a housing and a retainer. The housing includes a component receiving opening which extends through a mating end. The housing is molded from a first material. The retainer is integrally molded to the housing and positioned proximate the mating end. The retainer includes latching arms, at least one engagement portion, and latching arm guards. The retainer cooperates with a mating component to retain the mating component in the component receiving opening. As the at least one engagement portion is moved toward the housing, the at least one engagement portion causes latching portions of the latching arms to move out of or partially out of the component receiving opening.

An embodiment is directed to an electrical connector having a housing and a retainer. The housing includes a component receiving opening which extends through a mating end. The housing is molded from a first material. The retainer is integrally molded to the housing and positioned proximate the mating end. The retainer includes latching arms, at least one engagement portion, and latching arm guards. The retainer cooperates with a mating component to retain the mating component in the component receiving opening. The latching arms include free ends, latching portions, and fixed ends. As the latching portions are moved relative to the fixed ends, the latching portions move out of the component receiving opening. The latching arm guards are integrally attached to a first wall of the housing. As the at least one engagement portion is moved toward the housing, the at least one engagement portion causes latching portions of the latching arms to move out of or partially out of the component receiving opening.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
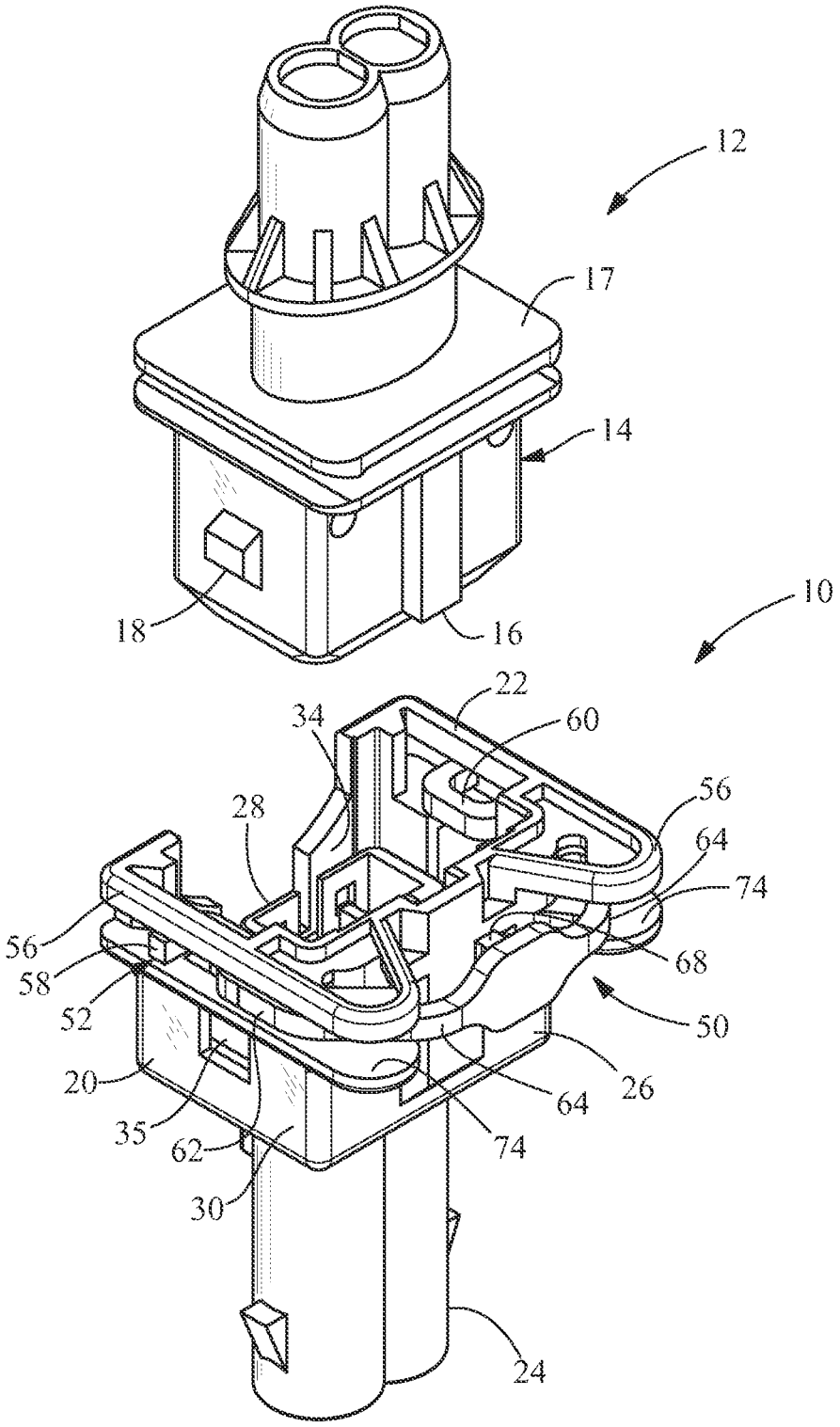
FIG. 1 is a front perspective view of a connector according to the disclosure and a mating connector.

The present invention will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that spatially relative terms, such as "top", "upper", "lower" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "over" other elements or features would then be oriented "under" the other elements or features. Thus, the exemplary term "over" can encompass both an orientation of over and under. The device may be otherwise oriented (rotated 90 degrees or at other orientations) and the spatially relative descriptors used herein interpreted accordingly.

The connector of the subject invention is identified generally by the numeral 10 in FIG. 1. The connector 10 is intended for mounting to a mating connector or component which is identified generally by the numeral 12 in FIG. 1. Such components 12 may be used in various industries, including, but not limited to automotive, commercial vehicles, and consumer electronics. The component 12 to which the subject connector 10 is mountable comprises a housing 14 of generally opened rectangular configuration and defining a mating end 16 and a back end 17. Terminals (not shown) are mounted within the rectangular housing 14 and project toward the open mating end 16. A pair of locking wedges 18 project from the exterior of the housing 14. The electrical connector 10 of the subject invention is lockingly and sealingly engageable with the component 12 to provide a high quality electrical connection therebetween.

The connector 10 includes an insulator housing 20 which is unitarily molded from polyester or other suitable plastic material. The insulator housing 20 comprises a mating end 22 and an opposed wire mounting end 24. The mating end 22 of the insulator housing 20 defines the portion of the connector 10 that is lockingly engageable with the housing 14 of the component 12.

Figure 2:
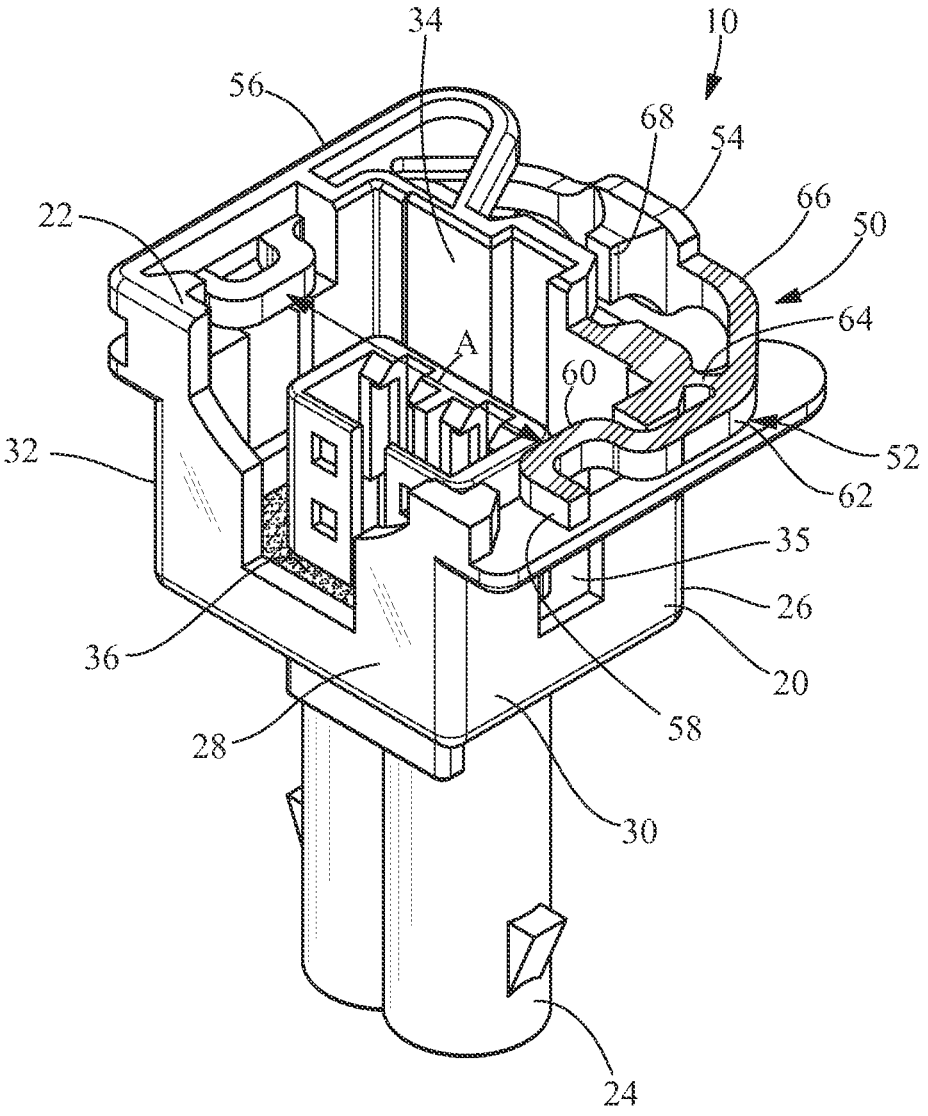
FIG. 2 is a back perspective view of the connector of FIG. 1 with a portion removed to better show the latching members.

As shown in the illustrative embodiments of FIGS. 1 and 2, the insulator housing 20 is of unitary molded construction and of generally rectangular external configuration, with opposed top and bottom walls 26, 28 and opposed side walls 30, 32. Other configurations of the insulator housing 20 can be used without departing from the scope of the invention. The terms top and bottom are used herein for identification purposes only, and do not imply a required gravitational orientation. A component receiving opening 34 extends between the first or top wall 26 and the second or bottom wall 28 and between the side walls 30, 32. The component receiving opening 34 extends from the mating end 22 toward the wire mounting end 24. The component receiving opening 34 is dimensioned to receive the housing 14 of the component 12 therein. Slots 35 extend from the component receiving opening 34 through the side walls 30, 32.

A mating seal 36 (FIG. 2) is provided in the component receiving opening 34. The mating seal 36 is inserted or bi-injection molded into the component receiving opening 34 such that the mating seal 36 is integrally molded to the insulator housing 20. Bi-injection molding allows both the housing 20 and the mating seal 36 to be molded in the same mold. By first injecting the material for the housing into the mold and then injecting the material for the mating seal, the housing with the mating seal attached is manufactured as one piece. Bi-injection molding decreases cycle production time of the connector 10 and decreases the time required to assemble the connector.

The housing 20 is made from Poly Butylene Terephthalate (PBT), polyester or other suitable material having the insulation and strength characteristics required. The mating seal 36 is made from silicon or other material having the deformable and water resistant characteristics required to allow the mating end 16 of the housing 14 of the component 12 to form a water tight seal with the mating seal 36.

As best shown in FIGS. 1 and 2, a resilient component retainer 50 is provided proximate the mating end 22 of the insulator housing 20. The retainer 50 is unitarily molded into the insulator housing 20 generally adjacent the mating end 22 thereof for locking engagement with the locking wedges 18 on the housing 14 of the component 12.

The retainer 50 includes movable latching arms 52, at least one engagement portion 54 and latching arm guards 56. As best shown in FIG. 2, each movable locking arm 52 includes a free end 58, a component latching portion 60 and a fixed end 62 which is integrally attached to a support arm 64 and to an arm 66 which extends from the engagement portion 54. The engagement portion has a projection 68 which extends from the engagement portion 54 toward the top wall 26 of the housing 20. The support arms 64 are integrally attached to either the top wall 26, the side walls 30, 32, a combination of the top wall 26 and the side walls 30, 32, or a corner which extends between the top wall 26 and the side walls 30, 32.

The component latching portions 60 extend into the component receiving opening 34 through both side walls 30, 32. The component latching portions 60 are spaced apart from each other by a distance A (FIG. 2) which is less than the width of the component receiving opening 34.

The guards 56 are integrally attached to either the top wall 26, side walls 30, 32, a combination of the top wall 26 and the side walls 30, 32, or corners which extend between the top wall 26 and the side walls 30, 32. Each guard 56 has a slot 74 (FIG. 1) which is dimensioned to receive portions of the latching arms 52 and the engagement portion 54 therein.

Figure 3:
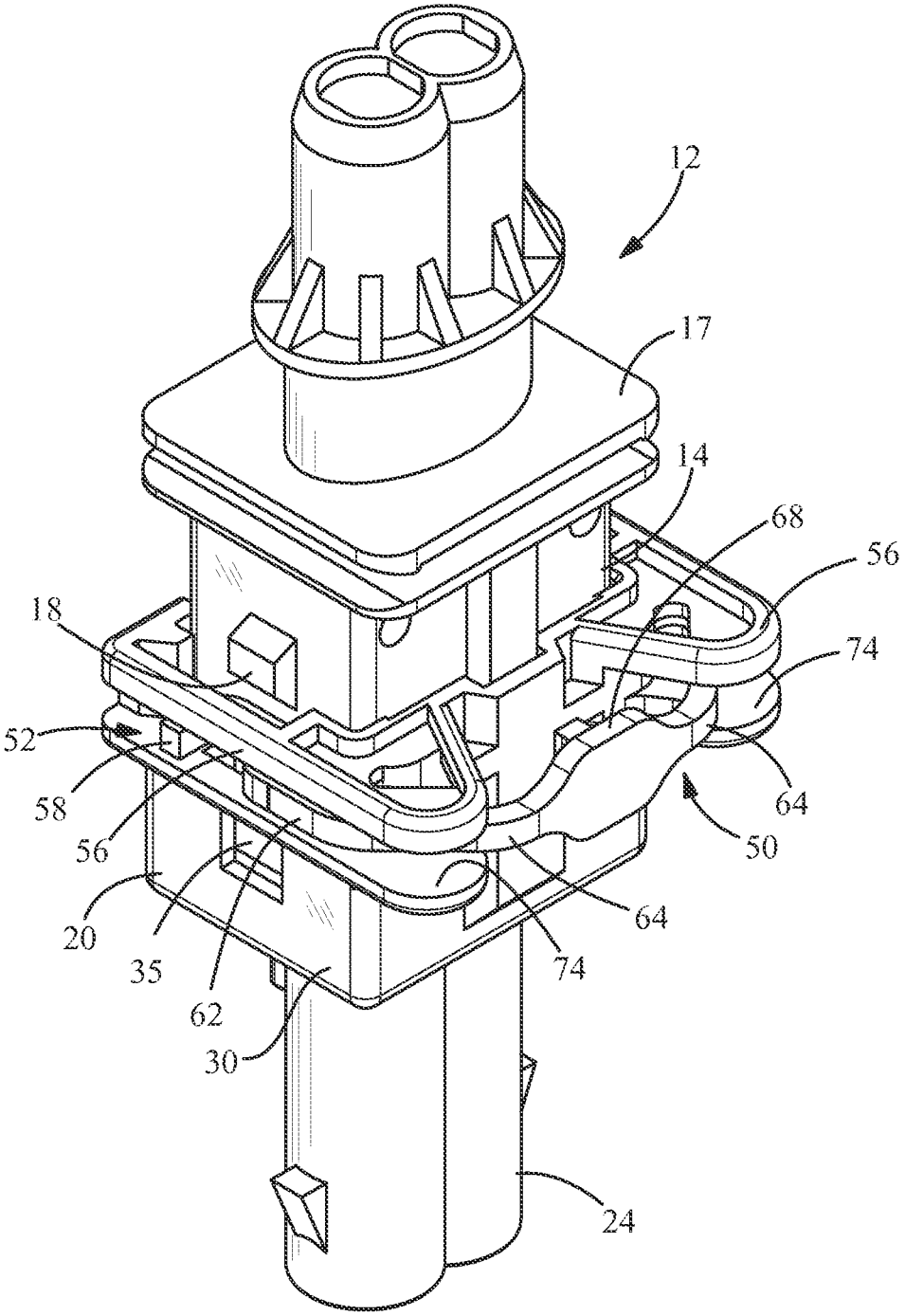
FIG. 3 is a perspective view of the connector of FIG. 1 partially mated with a mating connector.
Figure 4:
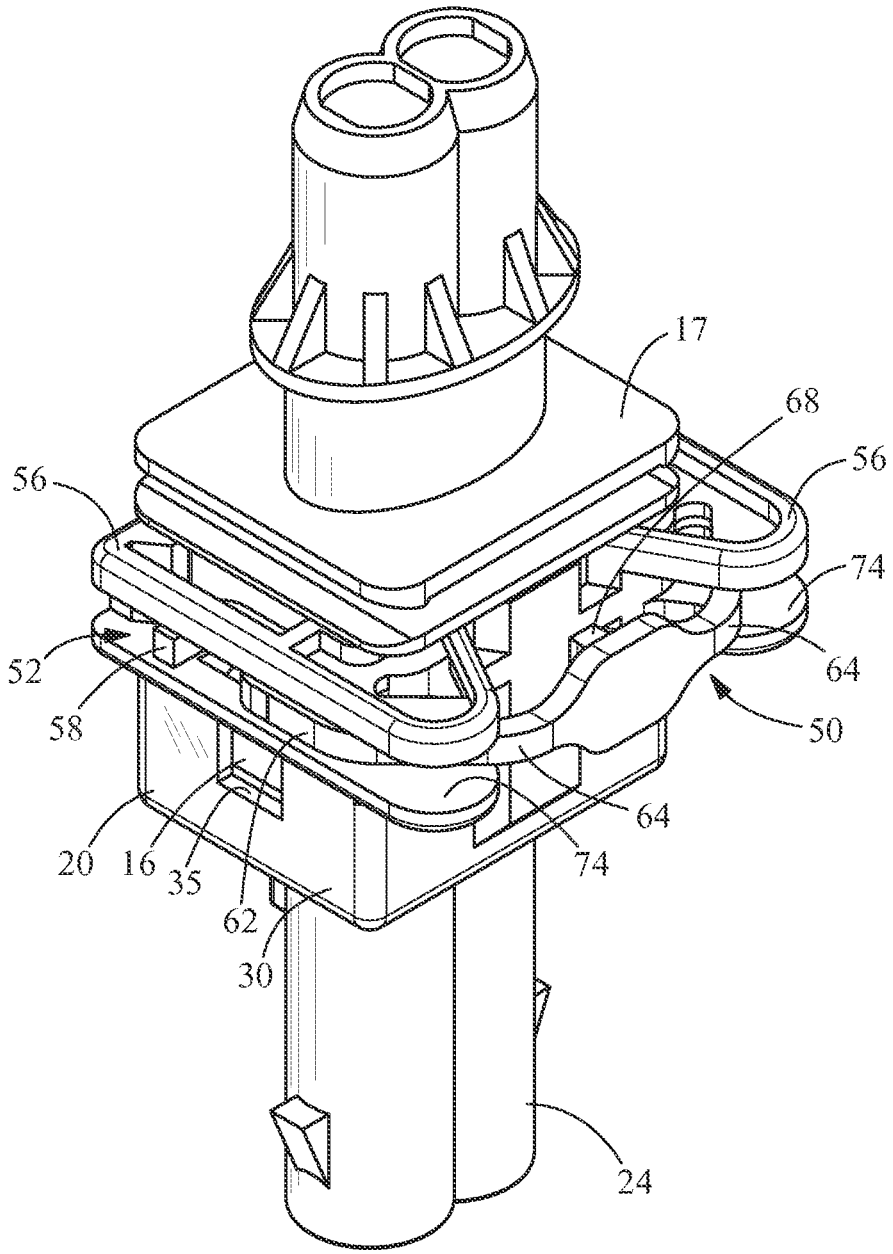
FIG. 4 is a perspective view of the connector of FIG. 1 fully mated with a mating connector.

As shown in FIGS. 3 and 4, in use, the mating end 16 of the housing 14 is inserted into the component receiving opening 34 of the housing 20. As the insertion occurs, the locking projections 18 of the component 12 engage the component latching portions 60, causing the component latching portions 60 and the movable latching arms 52 to move away from the component receiving opening 34. In so doing, the component latching portions 60 and the free ends 58 move, rotate or pivot about the fixed ends 62 and the support arms 64, allowing the component latching portions 60 to move out of or partially out of the component receiving opening 34. This provides sufficient clearance to allow for the continued insertion of the housing 14 of the component 12. As the latching arms 52 are rotated or moved, the fixed ends 62 and the support arms 64 are moved into a stressed position.

Insertion continues until the mating end 16 engages and compresses the mating seal 36, thereby allowing the mating end 16 of the housing 14 of the component 12 to form a water tight seal with the mating seal 36. As this occurs, the locking wedges 18 of the housing 14 are moved past the component latching portions 60 of the latching arms 52 and into the slots 35 extending from the component receiving opening 34. As this occurs, the fixed ends 62 and the support arms 64 return toward their unstressed or original position, causing the component latching portions 60 to move back into the component receiving opening 34. In this position the component latching portions 60 cooperate with the locking projections 18 to prevent the locking projections 18 and the housing 14 from being removed from the component receiving opening 34, thereby preventing the unwanted removal of the component 12 from the connector 10.

The guards 56 are provided to protect the movable latching arms 52 and the engagement portion 54 from damage and unwanted contact with other components or wires in the surrounding environment, thereby reducing the possibility of wires becoming tangled with the movable latching arms 52 and the engagement portion 54. The guards 56 also provide sufficient space or clearance for the movable latching arms 52 and the engagement portion 54 to properly operate or move without engaging other components or wires.

When the connector 10 is to be removed from the component 12, the user depresses the engagement portion 54 toward the top wall 26. As this occurs, the arms 66 move, rotate or pivot about the support arms 64. As the arms 66 are integrally attached to the fixed ends 62 of the latching arms 52, the movement of the arms 66 about the support arms 64 causes the component latching portions 60 and the free ends 58 to move, rotate or pivot about the fixed ends 62 and the support arms 64, allowing the component latching portions 60 to move out of or partially out of the component receiving opening 34. This provides sufficient clearance to allow for the locking projections 18 to move past the component latching portions 60 and allow for the removal of the housing 14 of the component 12 from the component receiving opening 34 of the housing 20. As the latching arms 52 are rotated or moved, the fixed ends 62 and the support arms 64 are moved into a stressed position.

The movement of the engagement portion 54 is controlled to prevent the overstress of the support arms 64. As the engagement portion 54 is depressed, the amount of movement is limited by the engagement of the projection 68 with the top wall 26. The projection 68 is configured to engage the top wall 26 prior to causing the support arms 64 from being overstressed and taking a permanent set.

Upon release of the engagement portion 54, the fixed ends 62 and the support arms 64 return toward their unstressed or original position, causing the component latching portions 60 to move back into the component receiving opening 34.

Figure 5:
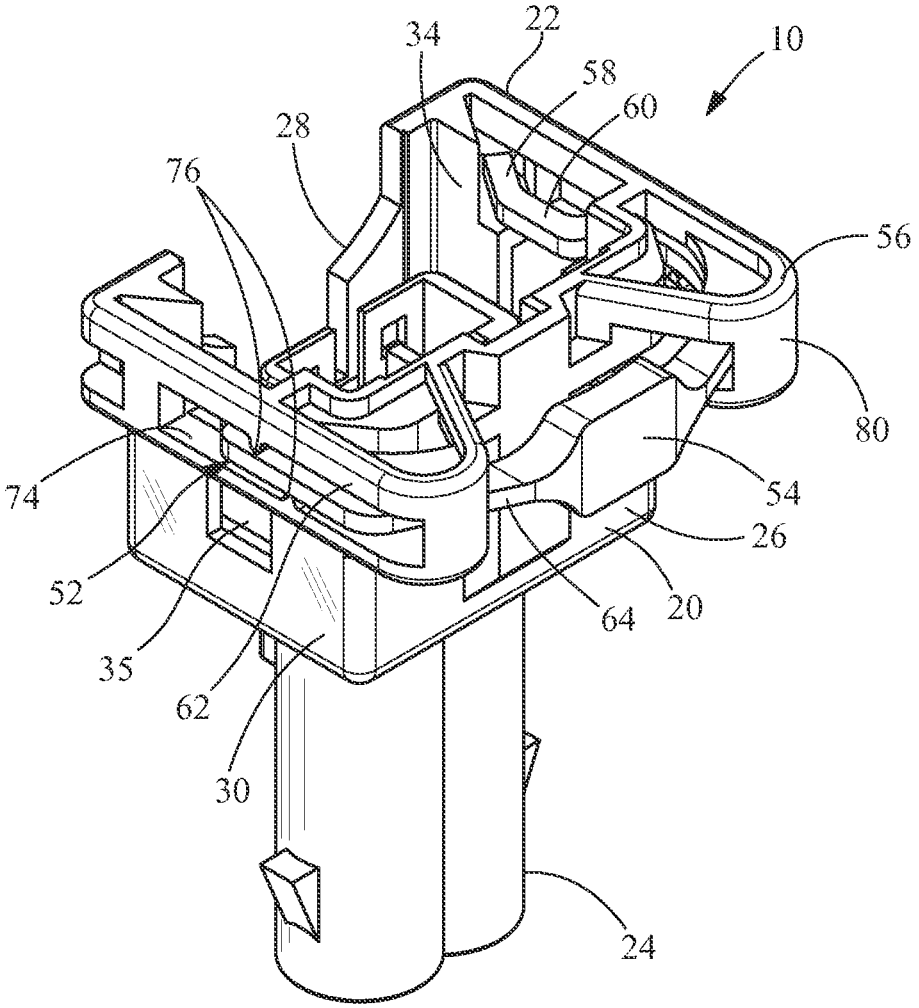
FIG. 5 is a front perspective view of a connector with integral latching members, according to the disclosure.

As shown in FIG. 5, other embodiments of the connector 10 may be provided. In this embodiment, many of the components operate as described above. In addition, spacers 76 are provided periodically on guards 56 to maintain the position of the latching arms 52 and the engagement portion 54 relative to the guards 56. Portions 80 are also provided on guards 56 to provide additional protection to protect the movable latching arms 52 and the engagement portion 54 from damage and unwanted contact with other components or wires in the surrounding environment, thereby further reducing the possibility of wires becoming tangled with the movable latching arms 52 and the engagement portion 54.

Figure 6:
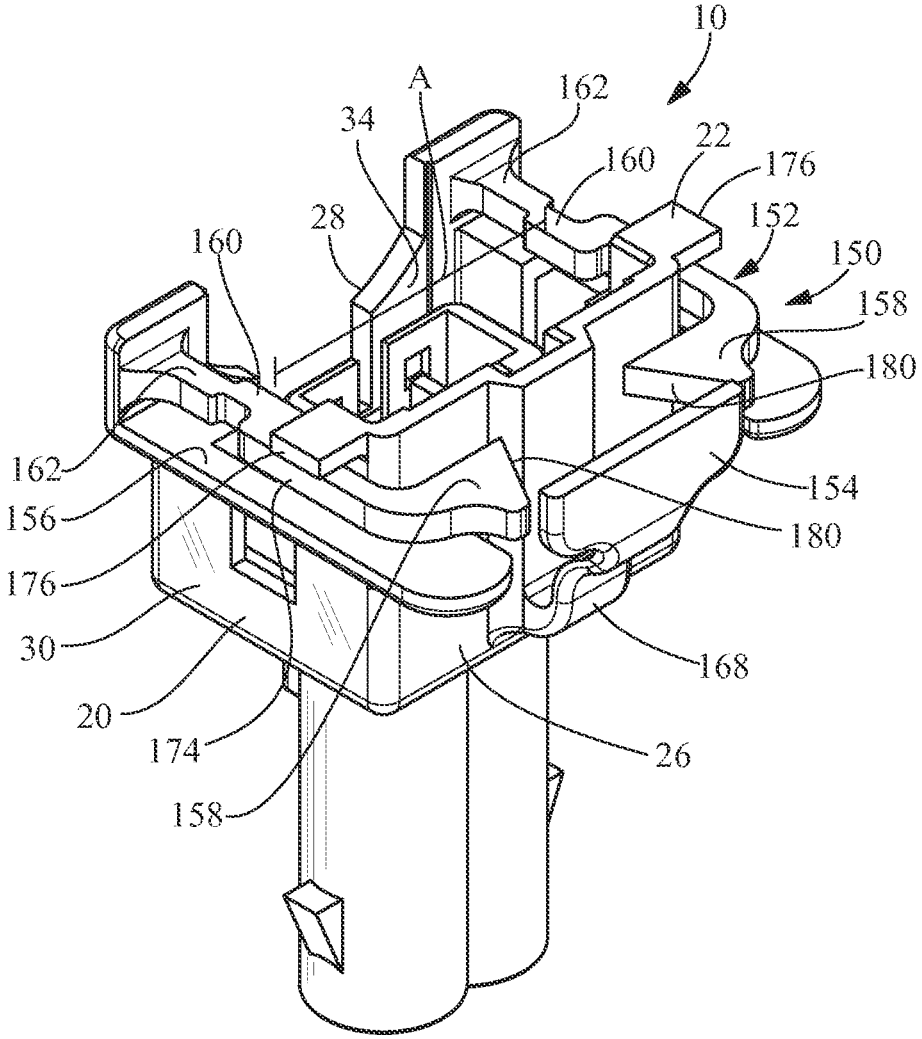
FIG. 6 is a front perspective view of a connector with integral latching members, according to the disclosure.

As shown in FIG. 6, another embodiment of connector 10 includes a resilient component retainer 150 provided proximate the mating end 22 of the insulator housing 20. The retainer 150 is unitarily molded into the insulator housing 20 generally adjacent the mating end 22 thereof for locking engagement with the locking wedges 18 on the housing 14 of the component 12.

The retainer 150 includes movable latching arms 152, a engagement portion 154 and guards 156. Each movable locking arm 152 includes a free end 158, a component latching portion 160 and a fixed end 162. The engagement portion 154 has an arm 168 which extends from proximate the bottom wall 28 of the housing 20.

The component latching portions 160 extend into the component receiving opening 34 from both side walls 30, 32. The component latching portions 160 are spaced apart from each other by a distance A which is less than the width of the component receiving opening 34.

The guards 156 are integrally attached to either the top wall 26, side walls 30, 32, a combination of the top wall 26 and the side walls 30, 32, or corners which extend between the top wall 26 and the side walls 30, 32. Each guard 156 is dimensioned to extend beyond the latching arms 152. Positioning projections 176 extend from the housing 20. Slots 174 are formed between the projections 176 and guards 156 to maintain the position of the latching arms 152 relative to the guards 156 and the housing 20.

In use, the mating end 16 of the housing 14 is inserted into the component receiving opening 34 of the housing 20. As the insertion occurs, the locking projections 18 of the component 12 engage the component latching portions 160, causing the component latching portions 160 and the movable latching arms 152 to move away from the component receiving opening 34. In so doing, the component latching portions 160 and the free ends 158 move, rotate or pivot about the fixed ends 162, allowing the component latching portions 160 to move out of or partially out of the component receiving opening 34. This provides sufficient clearance to allow for the continued insertion of the housing 14 of the component 12. As the latching arms 152 are rotated or moved, the fixed ends 162 are moved into a stressed position.

Insertion continues until the mating end 16 engages and compresses the mating seal 36, thereby allowing the mating end 16 of the housing 14 of the component 12 to form a water tight seal with the mating seal 36. As this occurs, the locking wedges 18 of the housing 14 are moved past the component latching portions 160 of the latching arms 152 and into the slots 35 extending from the component receiving opening 34. As this occurs, the fixed ends 162 return toward their unstressed or original position, causing the component latching portions 160 to move back into the component receiving opening 34. In this position the component latching portions 160 cooperate with the locking projections 18 to prevent the locking projections 18 and the housing 14 from being removed from the component receiving opening 34, thereby preventing the unwanted removal of the component 12 from the connector 10.

The guards 156 are provided to protect the movable latching arms 152 and the engagement portion 154 from damage and unwanted contact with other components or wires in the surrounding environment, thereby reducing the possibility of wires becoming tangled with the movable latching arms 152 and the engagement portion 154. The guards 156 also provide sufficient space or clearance for the movable latching arms 152 and the engagement portion 54 to properly operate or move without engaging other components or wires. In addition, the projections 176 and the guards 156 maintain the movable latching arms 152 in proper position.

When the connector 10 is to be removed from the component 12, the user depresses the engagement portion 154 toward the top wall 26. As this occurs, the engagement portion 154 contacts angled surfaces 180 of the free ends 158 of the latching arms 152. The continued movement of the engagement portion 154 toward the top wall 26 causes the engagement portion 154 to engage the angled surfaces 180, causing the latching arms 152 move, rotate or pivot about the fixed end 162, causing component latching portions 160 to move out of or partially out of the component receiving opening 34. This provides sufficient clearance to allow for the locking projections 18 to move past the component latching portions 160 and allow for the removal of the housing 14 of the component 12 from the component receiving opening 34 of the housing 20. As the latching arms 152 are rotated or moved, the fixed ends 162 are moved into a stressed position.

The movement of the engagement portion 154 is controlled to prevent the overstress of the latching arms 152. As the engagement portion 154 is depressed, the amount of movement is limited by the engagement of the engagement portion 154 with the top wall 26. In addition, the angled surfaces 180 are configured to control the movement of the latching arms 152. Consequently, the fixed ends 162 of the latching arms 152 are protected from being overstressed and taking a permanent set.

Upon release of the engagement portion 154, the engagement portion 154 and the fixed ends 162 return toward their unstressed or original position, causing the component latching portions 160 to move back into the component receiving opening 34.

Figure 7:
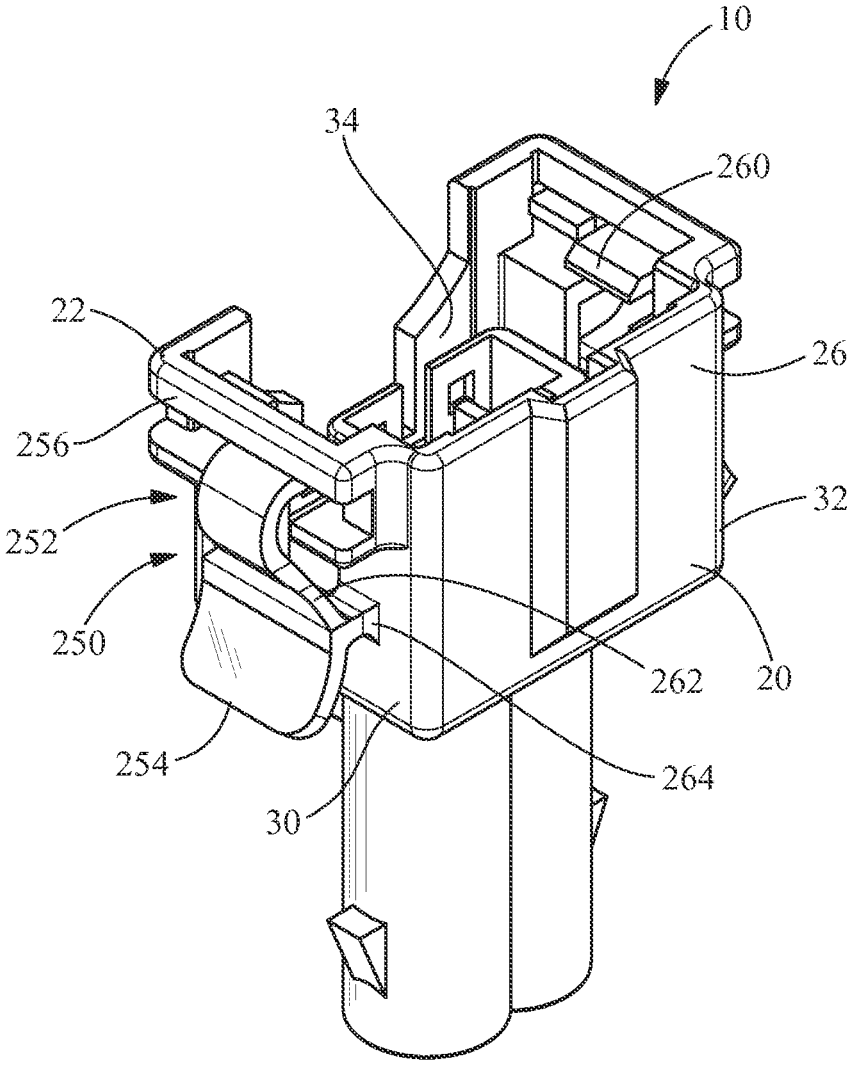
FIG. 7 is a front perspective view of a connector with integral latching members, according to the disclosure.
Figure 8:
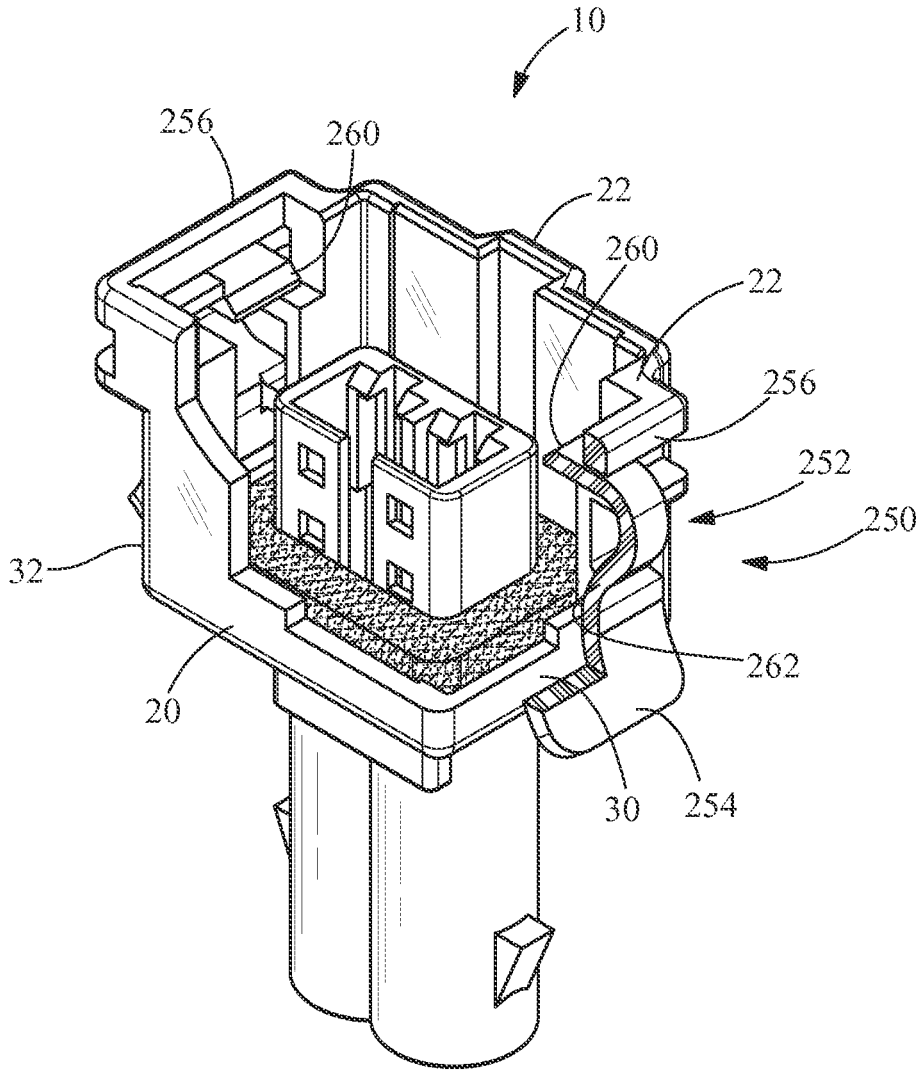
FIG. 8 is a back perspective view of the connector of FIG. 7 with a portion removed to better show the latching members.

As shown in FIGS. 7 and 8, another embodiment of the connector 10 includes resilient component retainers 250 provided proximate the mating end 22 of the insulator housing 20. The retainers 250 are unitarily molded into the insulator housing 20 generally adjacent the mating end 22 thereof for locking engagement with the locking wedges 18 on the housing 14 of the component 12.

The retainers 250 include movable latching arms 252, engagement portions 254 and guards 256. Each movable locking arm 252 includes a free end or component latching portion 260 and a fixed end 262 which is integrally attached to a support arm 264 and to the engagement portion 254. The support arms 264 are integrally attached to the side walls 30, 32.

The component latching portions 260 extend into the component receiving opening 34 from both side walls 30, 32. The component latching portions 260 are spaced apart from each other by a distance which is less than the width of the component receiving opening 34.

The guards 256 are integrally attached to the either the top wall 26, side walls 30, 32, a combinations thereof, or corners which extend therebetween.

In use, the mating end 16 of the housing 14 is inserted into the component receiving opening 34 of the housing 20. As the insertion occurs, the locking projections 18 of the component 12 engage the component latching portions 260, causing the component latching portions 260 and the movable latching arms 252 to move away from the component receiving opening 34. In so doing, the component latching portions 260 move, rotate or pivot about the fixed ends 262 and the support arms 264, allowing the component latching portions 260 to move out of or partially out of the component receiving opening 34. This provides sufficient clearance to allow for the continued insertion of the housing 14 of the component 12. As the latching arms 252 are rotated or moved, the fixed ends 262 and the support arms 64 are moved into a stressed position.

Insertion continues until the mating end 16 engages and compresses the mating seal 36, thereby allowing the mating end 16 of the housing 14 of the component 12 to form a water tight seal with the mating seal 36. As this occurs, the locking wedges 18 of the housing 14 are moved past the component latching portions 260 of the latching arms 252 and into the slots 35 extending from the component receiving opening 34. As this occurs, the fixed ends 262 and the support arms 264 return toward their unstressed or original position, causing the component latching portions 260 to move back into the component receiving opening 34. In this position the component latching portions 260 cooperate with the locking projections 18 to prevent the locking projections 18 and the housing 14 from being removed from the component receiving opening 34, thereby preventing the unwanted removal of the component 12 from the connector 10.

The guards 256 are provided to protect the movable latching arms 252 and the engagement portion 254 from damage and unwanted contact with other components or wires in the surrounding environment, thereby reducing the possibility of wires becoming tangled with the movable latching arms 252 and the engagement portion 254. The guards 256 also provide sufficient space or clearance for the movable latching arms 252 and the engagement portion 254 to properly operate or move without engaging other components or wires.

When the connector 10 is to be removed from the component 12, the user depresses the engagement portions 254 toward respective side walls 30, 32. As this occurs, the engagement portions 254 move, rotate or pivot about the support arms 264. As the engagement portions 254 are integrally attached to the fixed ends 262 of the latching arms 252, the movement of the engagement portions 254 about the support arms 264 causes the component latching portions 260 to move, rotate or pivot about the fixed ends 262 and the support arms 264, allowing the component latching portions 260 to move out of or partially out of the component receiving opening 34. This provides sufficient clearance to allow for the locking projections 18 to move past the component latching portions 260 and allow for the removal of the housing 14 of the component 12 from the component receiving opening 34 of the housing 20. As the latching arms 252 are rotated or moved, the fixed ends 262 and the support arms 264 are moved into a stressed position.

The movement of the component latching portions 260 is controlled to prevent the overstress of the support arms 264. As the engagement portion 254 is depressed, the amount of movement is limited by the engagement of the component latching portions 260 with the guard 256, thereby preventing the support arms 264 from being overstressed and taking a permanent set.

Upon release of the engagement portion 254, the fixed ends 262 and the support arms 264 return toward their unstressed or original position, causing the component latching portions 260 to move back into the component receiving opening 34.

While the invention has been described with reference to an illustrative embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector comprising:

a housing having a component receiving opening extending through a mating end, the housing being molded from a first material;

a retainer positioned proximate the mating end, the retainer being integrally molded to the housing, the retainer cooperating with a mating component to retain the mating component in the component receiving opening, the retainer includes latching arms, at least one engagement portion, and latching arm guards; and the latching arms have free ends, latching portions, and fixed ends, wherein the latching portions are moved relative to the fixed ends allowing the latching portions to move out of the component receiving opening.

2. The electrical connector as recited in claim 1, wherein the fixed ends of the latching arms are integrally attached to support arms.

3. The electrical connector as recited in claim 1, wherein a seal is provided in the component receiving opening, the seal is bi-injection molded in the component receiving opening of the housing, the seal is molded from a second material which is different than the first material.

4. The electrical connector as recited in claim 1, wherein the at least one engagement portion has a projection which extends from the at least one engagement portion toward a first wall of the housing, the at least one engagement portion cooperates with the housing to limit the movement of the at least one engagement portion.

5. The electrical connector as recited in claim 1, wherein support arms are integrally attached to the retainer and either a first wall of the housing, a side wall of the housing, a combination of the top wall and the side wall or a corner which extends between the top wall and the side wall.

6. The electrical connector as recited in claim 1, wherein the latching portions extend into the component receiving opening through side walls of the housing and are spaced apart from each other by a distance which is less than a width of the component receiving opening.

7. The electrical connector as recited in claim 1, wherein latching arm guards are integrally attached to the either a first wall of the housing, a side wall of the housing, a combination of the top wall and the side wall or a corner which extends between the top wall and the side wall.

8. The electrical connector as recited in claim 7, wherein the latching arm guards have slots which are dimensioned to receive portions of the latching arms and the at least one engagement portion therein.

9. The electrical connector as recited in claim 8, wherein in addition, spacers are provided periodically on the latching arm guards to maintain the position of the latching arms and the at least one engagement portion relative to the latching arm guards.

10. The electrical connector as recited in claim 1, wherein the at least one engagement portion has an arm which extends from proximate a first wall of the housing.

11. The electrical connector as recited in claim 7, wherein positioning projections extend from the housing, slots are formed between the projections and latching arm guards, whereby the positioning projections cooperate with the latching arms to maintain the latching arms in position.

12. The electrical connector as recited in claim 1, wherein the latching arms have angled surfaces at free ends thereof, wherein as the at least one engagement portion is moved toward a first wall of the housing, the at least one engagement portion contacts the angled surfaces, causing latching portions of the latching arms to move out of or partially out of the component receiving opening.

13. The electrical connector as recited in claim 1, wherein as the at least one engagement portion is moved toward the housing, the at least one engagement portion causes latching portions of the latching arms to move out of or partially out of the component receiving opening.

14. An electrical connector comprising:

a housing having a component receiving opening extending through a mating end, the housing being molded from a first material; and a retainer integrally molded to the housing and positioned proximate the mating end, the retainer having latching arms, at least one engagement portion, and latching arm guards, the retainer cooperating with a mating component to retain the mating component in the component receiving opening;

wherein as the at least one engagement portion is moved toward the housing, the at least one engagement portion causes latching portions of the latching arms to move out of or partially out of the component receiving opening.

15. The electrical connector as recited in claim 14, wherein the at least one engagement portion has a projection which extends from at least one engagement portion toward the housing, the at least one engagement portion cooperates with the housing to limit the movement of the at least one engagement portion.

16. The electrical connector as recited in claim 14, wherein a seal is provided in the component receiving opening, the seal being integrally molded in the component receiving opening of the housing, the seal being molded from a second material which is different than the first material.

17. An electrical connector comprising:

a housing having a component receiving opening extending through a mating end, the housing being molded from a first material; and a retainer integrally molded to the housing and positioned proximate the mating end, the retainer having latching arms, at least one engagement portion, and latching arm guards, the retainer cooperating with a mating component to retain the mating component in the component receiving opening;

the latching arms having free ends, latching portions, and fixed ends, wherein the latching portions are moved relative to the fixed ends allowing the latching portions to move out of the component receiving opening;

the latching arm guards being integrally attached to a first wall of the housing;

wherein as the at least one engagement portion is moved toward the housing, the at least one engagement portion causes latching portions of the latching arms to move out of or partially out of the component receiving opening.

18. The electrical connector as recited in claim 17, wherein a seal is provided in the component receiving opening, the seal being integrally molded in the component receiving opening of the housing, the seal being molded from a second material which is different than the first material.

19. An electrical connector comprising:

a housing having a component receiving opening extending through a mating end, the housing being molded from a first material;

a retainer positioned proximate the mating end, the retainer being integrally molded to the housing, the retainer cooperating with a mating component to retain the mating component in the component receiving opening; and a seal provided in the component receiving opening, the seal is bi-injection molded in the component receiving opening of the housing, the seal is molded from a second material which is different than the first material.

* * * * *